United States Patent [19]

York et al.

[11] Patent Number: 4,475,965

[45] Date of Patent: Oct. 9, 1984

[54] SHALE OIL EXPLOSIVES

[75] Inventors: Earl D. York; Darrell D. Porter, both of Englewood, Colo.

[73] Assignees: Standard Oil Company (Indiana); Gulf Oil Corp., both of Chicago, Ill.

[21] Appl. No.: 545,054

[22] Filed: Oct. 24, 1983

[51] Int. Cl.[3] ..... C06B 45/02

[52] U.S. Cl. ..... 149/21; 149/2; 149/46; 149/112; 149/115

[58] Field of Search ..... 149/2, 21, 46, 112, 149/115

[56] References Cited

U.S. PATENT DOCUMENTS 4,012,246 3/1977 Forrest ..... 149/60
4,132,574 1/1979 Forrest ..... 149/60

*Primary Examiner*—Stephen J. Lechert, Jr.
*Attorney, Agent, or Firm*—Thomas W. Tolpin; William T. McClain; William H. Magidson

[57] ABSTRACT

Ammonium nitrate shale oil explosives are provided which are effective, powerful, inexpensive, and safe. The explosives contain about 2% to 10% by weight shale oil and about 90% to 98% by weight ammonium nitrate. The shale oil can be whole shale oil or heavy shale oil containing from 0.1% to 65% by weight oil shale dust. The ammonium nitrate is preferably in the form of explosive grade ammonium nitrate prills.

15 Claims, 5 Drawing Figures

LIGHT GASES
WATER
LIGHT SHALE OIL
MIDDLE SHALE OIL
DUST LADEN HEAVY SHALE OIL
SPENT SHALE
RETORT
RAW OIL SHALE
LIFT PIPE
HEATER
AMMONIUM NITRATE
MIXER
10
12
14
16
18
20
22
24
25
26
27
28
29
30
32
34
36
38
40
42
44
46
48
50
52

52
50
SPENT SHALE
16
18
22
24
25
LIGHT GASES
26
WATER
12
14
RETORT
20
44
RAW OIL SHALE
LIFT PIPE
DUST LADEN WHOLE SHALE OIL
29'
HEATER
30
40
42
34
36
AMMONIUM NITRATE
MIXER
32
38'
46

FEED GAS
FUEL GAS
74
64
76
66
70
78
SHALE OIL
91
93
95
HEATER
30
SPENT SHALE
98
COMBUSTION ZONE
97
50
RETORTED SHALE
96
62
RETORTING ZONE
82
60
72
89
85
94
68
90
86
88
84
92
SHALE OIL
WATER
34
36
AMMONIUM NITRATE
MIXER
32
38

104
108
100
110
112
114
102
106

130
126
129
128
122
120
124
132
136
138
134
140
141
144
145
COUNTER
0 0 0
142
146

SHALE OIL EXPLOSIVES

BACKGROUND OF THE INVENTION

This invention relates to explosives, and more particularly, to ammonium nitrate fuel oil (ANFO) produced from oil shale.

Researchers have now renewed their efforts to find alternate sources of energy and hydrocarbons in view of recent rapid increases in the price of crude oil and natural gas. Much research has been focused on recovering hydrocarbons from solid hydrocarbon-containing material such as oil shale, coal and tar sands by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be readily recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts in aboveground vessels or in in situ retorts under ground. In principle, the retorting of shale and other hydrocarbon-containing materials, such as coal and tar sands, comprises heating the solid hydrocarbon-containing material to an elevated temperature and recovering the vapors and liberated effluent. However, as medium grade oil shale yields approximately 20 to 25 gallons of oil per ton of shale, the expense of materials handling is critical to the economic feasibility of a commercial operation.

In situ retorts require less mining and handling than surface retorts. In vertical in situ retorts, a flame front moves downward through a rubblized bed of oil shale to liberate shale oil, off gases and condensed water.

There are two types of in situ retorts: true in situ retorts and modified in situ retorts. In true in situ retorts, none of the shale is mined, holes are drilled into the formation and the oil shale is explosively rubblized, if necessary, and then retorted. In modified in situ retorts, some of the oil shale is removed by mining before being explosively rubblized to create a cavity which provides extra space for explosively expanded oil shale. The oil shale which has been removed is conveyed to the surface and retorted above ground.

Typifying the many methods of in situ retorting and explosively forming in situ retorts are those found in U.S. Pat. Nos. 1,913,395; 1,191,636; 2,418,051; 3,001,776; 3,586,377; 3,434,757; 3,661,423; 3,951,456; 3,980,339; 4,007,963; 4,017,119; 4,105,251; 4,120,355; 4,126,180; 4,133,380; 4,149,752; 4,153,300; 4,158,467; 4,177,886; 4,185,871; 4,194,788; 4,199,026; 4,210,867; 4,210,868; 4,231,617; 4,243,100; 4,263,969; 4,265,486; 4,266,608; 4,271,904; 4,315,656; 4,323,120; 4,323,121; 4,328,863; 4,343,360; 4,343,361; 4,353,418; and 4,378,949.

In surface retorting, oil shale is mined from the ground, brought to the surface, crushed and placed in vessels where it is contacted with a hot solid heat carrier material, such as hot spent shale, ceramic balls, metal balls, or sand or a gaseous heat carrier material, such as light hydrocarbon gases, for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spent oil shale relatively free of carbon. Spent oil shale which has been depleted in carbonaceous material is removed from the retort and recycled as heat carrier material or discarded. The combustion gases are dedusted in cyclones or electrostatic precipitators.

Surface retorting with solid heat carrier material has many advantages. The solid heat carrier material should be well mixed with the raw shale to enhance heat exchange and conversion of kerogen to shale oil and light hydrocarbon gases. There are many types of surface retorting processes. In the Lurgi-Ruhrgas process, spent shale is mechanically mixed with raw oil shale in a screw conveyor. In the Tosco II process, ceramic or metal balls (solid heat carrier material) are mechanically mixed with raw oil shale in a rotating pyrolysis drum. In the Union process, raw oil shale is retorted in a rock pump retort with a gaseous heat carrier medium. In the Parahoe process, raw oil shale is retorted in a moving grate retort. In fluid bed processes, spent shale is fluidly (turbulently) mixed with raw oil shale in the presence of a pressurized fluidizing gas. In static mixer and gravity flow processes, spent shale is mixed with raw oil shale in uninterrupted free fall or by gravity flow with the aid of stationary internals in a static mixer or gravity flow retort.

During fluid bed, moving bed and other types of surface retorting, decrepitation of oil shale occurs when particles of oil shale collide with each other and impinge against the walls of the retort forming minute entrained particulates of shale dust. The use of hot spent shale as heat carrier material can aggravate the dust problem. Shale dust is also emitted and carried away with the effluent product stream during modified in situ retorting as a flame front passes through a fixed bed of rubblized shale, as well as in fixed bed surface retorting, but dust emission is not as severe as in other types of surface retorting.

Shale dust ranges in size from less than 1 micron to 1000 microns and is entrained and carried away with the effluent product stream. Because shale dust is so small, it cannot be effectively removed to commercially acceptable levels by conventional dedusting equipment.

The retorting, carbonization or gasification of coal, peat and lignite and the retorting or extraction of tar sands and gilsonite may create similar dust problems.

After retorting, the effluent product stream of liberated hydrocarbons and entrained dust is withdrawn from the retort through overhead lines and subsequently conveyed to a separator, such as a single or multiple stage distillation column, quench tower, scrubbing cooler or condenser, where it is separated into fractions of light gases, light oils, middle oils and heavy oils with the bottom heavy oil fraction containing essentially all of the dust. As much as 65% by weight of the bottom heavy oil fraction consists of dust.

It is very desirable to upgrade the bottom heavy oil into more marketable products, such as light oils and middle oils, but the heavy oil fraction is laden with dust and it is very viscous and cannot be pipelined. Dust laden heavy oil plugs up hydrotreaters and catalytic crackers, gums up valves, heat exchangers, outlet orifices, pumps and distillation towers, builds up insulative layers on heat exchange surfaces reducing their efficiency and fouls up other equipment. Furthermore, the dusty heavy oil corrodes turbine blades and creates emission problems. Moreover, the dusty heavy oil cannot be refined with conventional equipment.

In an effort to solve this dust problem, gas-solid separation devices, such as electrostatic precipitators have been used as well as cyclones located both inside and outside the retort. Electrostatic precipitators and cyclones, however, must be operated at high temperatures and the product stream must be maintained at or above the temperature attained during the retorting process to prevent any condensation and accumulation of dust on processing equipment. Maintaining the effluent steam at high temperatures is not only expensive from an energy standpoint, but it allows detrimental side reactions, such as cracking, coking and polymerization of the effluent product stream, which tends to decrease the yield and quality of condensable hydrocarbons.

Over the years various processes and equipment have been suggested to decrease the dust concentration in the heavy oil fraction and/or upgrade the heavy oil into more marketable light oils and medium oils. Such prior art dedusting processes and equipment have included the use of cyclones, electrostatic precipitators, pebble beds, scrubbers, filters, spiral tubes, ebullated bed catalytic hydrotreaters, desalters, autoclave settling zones, sedimentation, gravity settling, percolation, hydrocloning, magnetic separation, electrical precipitation, stripping and binding, as well as the use of diluents, solvents and chemical additives before centrifuging. Typifying those prior art processes and equipment and related processes and equipment are those found in U.S. Pat. Nos. 2,235,639; 2,717,865; 2,719,114; 2,723,951; 2,793,104; 2,879,224; 2,899,736; 2,904,499; 2,911,349; 2,952,620; 2,968,603; 2,982,701; 3,008,894; 3,034,979; 3,058,903; 3,252,886; 3,255,104; 3,468,789; 3,560,369; 3,684,699; 3,703,442; 3,784,462; 3,799,855; 3,808,120; 3,900,389; 3,901,791; 3,929,625; 3,974,073; 3,990,885; 4,028,222; 4,040,958; 4,049,540; 4,057,490; 4,069,133; 4,080,285; 4,088,567; 4,105,536; 4,151,073; 4,159,949; 4,162,965; 4,166,441; 4,182,672; 4,199,432; 4,220,522; and 4,246,093 as well as in the articles by Rammler, R. W., *The Retorting of Coal, Oil Shale and Tar Sand By Means of Circulated Fine-Grained Heat Carriers as a Preliminary Stage in the Production of Synthetic Crude Oil,* Volume 65, Number 4, Quarterly of the Colorado School of Mines, pages 141–167 (Oct. 1970) and Schmalfeld, I. P., *The Use of The Lurgi/Ruhrgas Process For the distillation of Oil Shale,* Volume 70, Number 3, Quarterly of the Colorado School of Mines, pages 129–145 (July 1975). These prior art processes and equipment have not been successful in decreasing the dust concentration in the heavy oil fraction to commercially acceptable levels.

Over the years many different types of explosives, blasting agents and incendiary devices have been developed. Some of the more widely used explosives that have been around for decades, are nitroglycerin (dynamite) and trinitrotoluene (TNT). In recent years ammonium nitrate fuel oil (ANFO) has been the most widely used explosive because it is less expensive and more effective than dynamite and TNT. ANFO is a mixture of ammonium nitrate and No. 2 diesel fuel oil. Typifying the many types of explosives, blasting agents and incendiary devices are those shown in U.S. Pat. Nos. 2,530,491; 2,615,800; 2,886,424; 2,975,046; 2,987,389; 3,004,842; 3,032,450; 3,094,069; 3,147,163; 3,150,019; 3,180,768; 3,240,641; 3,279,965; 3,388,014; 3,447,978; 3,453,144; and 3,722,410, as well as in the *SME Mining Engineering Handbook,* published by the Society of Mining Engineers of the American Institute of Mining, Metallurgical, and Petroleum Engineers Inc., pages 11–88 to 11–96 and pages 17–139 to 17–142, Volume 1 (1973) and in the article by Clark, G. B., *Basic Properties of Ammonium Nitrate Fuel Oil Explosives (ANFO),* Volume 76, Number 1, Quarterly of the Colorado School of Mines, pages 1–32 (January, 1981). These explosives, blasting agents and incendiary devices have met with varying degrees of success.

It is therefore desirable to provide an improved explosive which overcomes most, if not all, of the preceding problems.

SUMMARY OF THE INVENTION

A novel explosive is produced from oil shale which is effective, powerful, and safe. Desirably, the explosive is made from ammonia by-products and dust-laden shale oil liberated during retorting oil shale. Advantageously, the production of the explosive from ammonia by-products and dust-laden shale oil substantially reduces the quantities of by-products and dusty oil that have to be cleaned up, dedusted, upgraded and/or otherwise processed. The result is considerable cost savings while producing a valuable and useful explosive product. The novel explosive can be used for a variety of purposes and is particularly useful for explosively fragmenting and rubblizing an underground in situ oil shale retort as well as for blasting open pit mines in oil shale tracts and nearby coal fields. Preferably, all of the dusty shale oil is made into explosives. For economic reasons or demand considerations, however, it may be desirable to process only some of the dusty shale oil into explosives.

Desirably, the explosive contains about 2% to 10% by weight shale oil and about 90% to 98% by weight ammonium nitrate. The shale oil can be whole shale oil or heavy shale oil containing from 0.1% to 60% by weight minute particulates of oil shale dust. The ammonium nitrate can be prilled, flaked or granulated, and can be coated with an antisetting or anticaking agent containing less than 2% by weight inert material.

As used throughout this application, the term "retorted" oil shale refers to raw oil shale which has been retorted to liberate shale oil and gases leaving a material containing carbon residue.

The term "spent" shale as used herein means retorted shale from which most of the carbon residue has been removed by combustion.

The term "dust" as used herein means particulates derived from oil shale which range in size from less than 1 micron to 1,000 microns. The particulates can include retorted and raw, unretorted oil shale as well as spent oil shale. Dust derived from retorting of oil shale consists primarily of clays, calcium, magnesium oxides, carbonates, silicates and silicas.

As used throughout this application, the term "explosive" also includes blasting agents unless specifically stated otherwise.

The terms "normally liquid," "normally gaseous," "condensable," "condensed" or "noncondensable" are relative to the condition of the subject material at a temperature of 77° F. (25° C.) at atmospheric pressure.

A more detailed explanation of the invention is provided in the following description and appended claims taken in conjunction with the accompanying drawings.

DETAILED DESCRIPTION OF THE PREFERRED EMBODIMENTS

Figure 1:
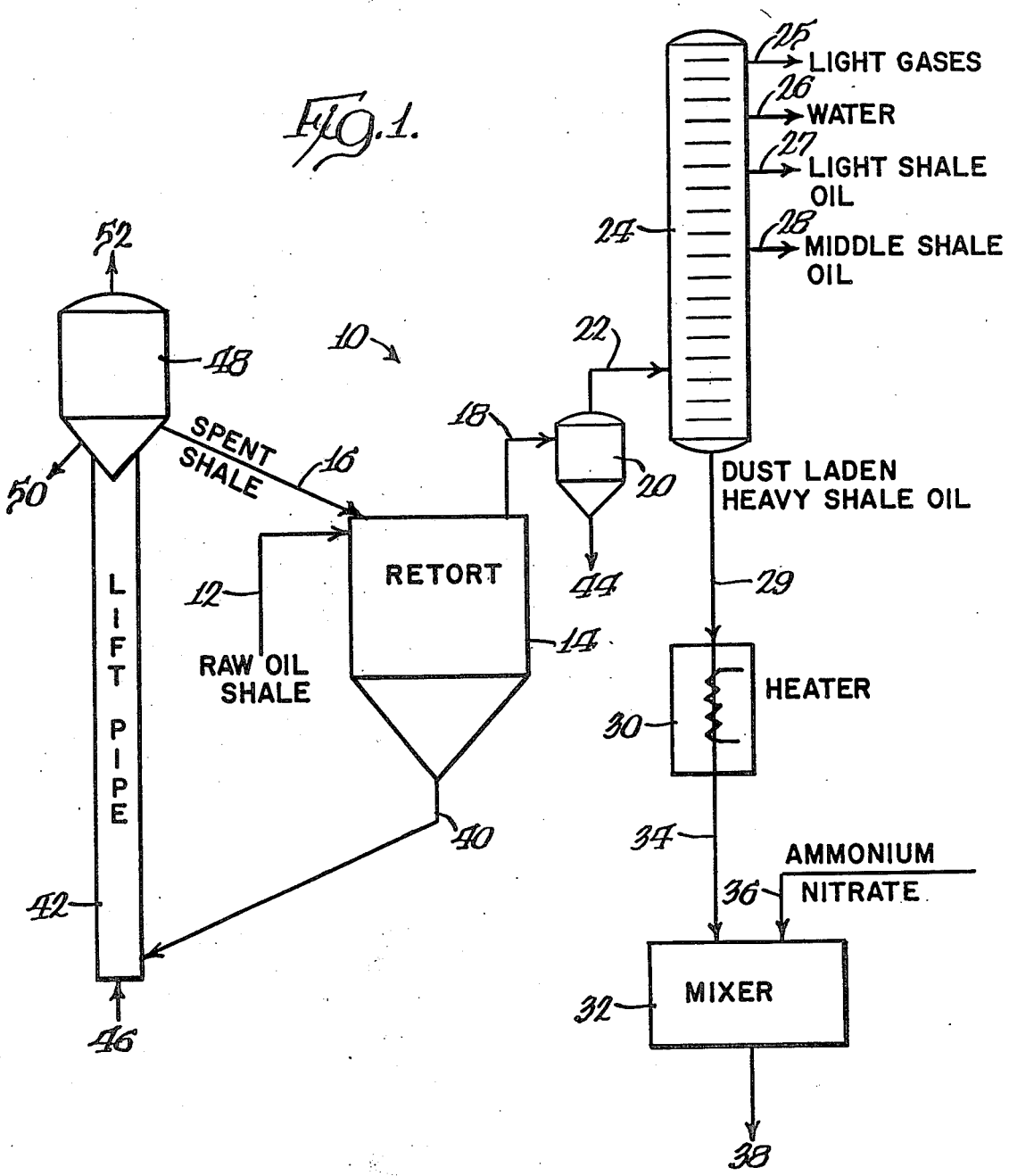
FIG. 1 is a schematic flow diagram of a surface oil shale retorting process for producing ammonium nitrate shale oil explosives in accordance with principles of the present invention.

Referring now to FIG. 1, an oil shale retorting process and system 10 is provided to produce shale oil, gas and explosives from raw oil shale. The raw, fresh oil shale can be obtained from open pit mining or underground mining. For example, the raw oil shale can be obtained from an open pit or underground formation of oil shale which has been rubblized and explosively fragmented with an ammonium nitrate shale oil explosive made in accordance with this invention. The oil shale preferably contains an oil yield of at least 15 gallons per ton of shale particles to minimize the amount of auxiliary fuel that needs to be added to the system.

The raw oil shale is crushed and sized to a maximum fluidizable size of 10 mm and fed through a raw shale inlet line 12 at a temperature from ambient temperature to 600° F. into an aboveground surface retort 14. The fresh oil shale can be crushed by conventional crushing equipment such as an impact crusher, jaw crusher, gyratory crusher or roll crusher and screened with conventional screening equipment, such as a shaker screen or vibrating screen.

Solid heat carrier material, preferably spent (combusted) oil shale is fed through heat carrier line 16 into the top of the retort to mix with, heat and retort the raw oil shale in the retort. Other types of solid heat carrier material can be used such as ceramic balls, metal balls, sand or combinations thereof.

The surface retort can be a gravity flow retort, such as a static mixer retort, a screw conveyor retort, a rotating pyrolysis drum retort, a fixed bed retort, a moving grate retort, a rock pump retort, or a fluidizing (fluid) bed retort. The gravity flow retort, static mixer retort, screw conveyor retort, and rotating paralysis drum retort preferably are two stage retorts: (1) the first stage primarily mixing the raw and spent oil shale together, and (2) the second stage being a surge bin, accumulator, or vessel. In the fixed bed retort and in the rock pump retort, a gaseous heat carrier material is preferably used in lieu of solid heat carrier material. In the fluidized bed retort, an inert fluidizing lift gas such as light hydrocarbon gases is injected into the bottom of the retort through a gas injector to fluidize, entrain and enhance mixing of the raw oil shale and solid heat carrier material in the retort.

In the preferred embodiment, air and molecular oxygen are prevented from entering the retort to prevent the effluent product stream of shale oil and gases liberated during retorting from being combusted in the retort.

The retorting temperature of the surface retort is from 850° F. to 1100° F., and preferably from 850° F. to 960° F., at atmospheric pressure. During retorting, hydrocarbons, ammonia, and steam are liberated from the raw oil shale as a gas, vapor, mist or liquid droplets and most likely a mixture thereof along with entrained particulates of oil shale dust ranging in size from less than 1 micron to 1000 microns.

The effluent product stream of hydrocarbons, ammonia and steam liberated during retorting are withdrawn from the upper portion of the retort through an overhead product line 18 and passed to one or more internal or external gas-solids separating device, such as a cyclone 20 or a filter, where it is partially dedusted. The partially dedusted stream exists the cyclone through exit line 22 where it is transported to one or more separators 24, such as a quench tower, scrubber or fractionator, also referred to as a fractionating column or distillation column. In the separator, the effluent product stream is separated into fractions of light hydrocarbon gases, water, light shale oil, middle shale oil, and heavy shale oil. The light hydrocarbon gases and water are partially or fully saturated with ammonia. These fractions are discharged from the separator through lines 25–29, respectively. Heavy shale oil has a boiling point over 600° F. to 800° F. Middle shale oil has a boiling point over 400° F. to 500° F. and light shale oil has a boiling point over 100° F.

The solids bottom heavy shale oil fraction in the bottom separator line 29 is a slurry of dust laden heavy shale oil that contains from 15% to 40% by weight of the effluent product stream. The dust laden heavy oil, which is also referred to as "dusty oil," consists essentially of normally liquid heavy shale oil and from 1% to 65% by weight and preferably a maximum of 25% by weight entrained oil shale particulates. The oil shale particulates are mainly minute particles of spent oil shale and lesser amounts of retorted and/or raw oil shale particulates. The temperature in the separator can be varied from 500° F. to 800° F., preferably to a maximum temperature of 600° F. at atmospheric pressure, to assure that essentially all the oil shale particulates gravitate to and are entrained in the solids bottom heavy oil fraction.

The dust-laden heavy shale oil is preferably fed to a heater 30 before being transported to a mixer 32 via transport line 34. Ammonium nitrate is fed into the mixer through ammonium nitrate feed line 36. In order to enhance mixing, the dusty heavy shale oil is heated in the heater to a temperature above its pour point to lower the viscosity of the heavy shale oil and make the dusty heavy shale oil more flowable and blendable before being mixed with the ammonium nitrate in the mixer. Heating serves to improve the mixing characteristics of the dusty shale oil as well as to minimize agglomeration. If the shale oil exiting the separator (fractionator) has relatively good flow and blending characteristics, the shale oil can be fed directly to the mixer without being heated in heater 30. The dusty shale oil preferably has a maximum viscosity of 50 saybolt universal seconds at the mixing temperature and a maximum agglomeration prill mesh size of one centimeter for best results.

In the mixer 32, from 90% to 98% by weight ammonium nitrate is mixed with the dust-containing shale oil to produce an ammonium nitrate shale oil explosive. The ammonium nitrate shale oil explosive is withdrawn from the mixer through discharge outlet 38.

While the ammonium nitrate can be granulated or flaked, it is preferably in the form of explosive grade prills coated with an antisetting or anticaking agent comprising an inert mineral filler powder. Low density explosive grade ammonium nitrate prills are preferred because they contain voids which are filled with air and can contain a portion of the oil. Low density explosive grade ammonium nitrate prills compress when the shock wave hits it upon detonation which causes the explosion. Low density explosive grade ammonium nitrate prills also readily absorb shale oil. Ammonium nitrate has a bulk density ranging from 0.8 gram/cc to 1.57 grams/cc. Desirably, the explosive grade ammonium nitrate prills have a bulk density of 0.82 grams/cc to 1.15 grams/cc for best results.

Ammonium nitrate has a favorable oxygen balance and heat of formation. Specifically, ammonium nitrate has an excellent ability to furnish oxygen and produce heat when it decomposes at high temperatures as an oxidizer in combination with shale oil. In large charge diameters, pure ammonium nitrate of proper particle size can maintain a stable detonation. Ammonium nitrate has a heat of formation of 2070 BTU/lb, a heat of fusion of 29.2 BTU/lb, a heat of solution of 142 BTU/lb, a melting point of 337.3° F. and a decomposition point between 392° F. and 500° F.

Ammonium nitrate is a white crystalline solid. It is very hydroscopic for this invention. Every reasonable precaution should be exercised to exclude moisture. Water decreases the sensitivity of ammonium nitrate shale oil explosives and increases the production of toxic fumes on detonation. Exposure of ammonium nitrate to moisture causes it to cake, causes the particulates to degradate, and beyond minor amounts reduces its sensitivity to detonation. Ammonium nitrate recrystallizes at 89.8° F., and heating and cooling above and below this temperature causes the ammonium nitrate prills or crystals to disentegrate, which increases its sensitivity to initiation, and accelerates caking if moisture is present. The ammonium nitrate desirably contains an anticaking or antisetting agent of less than 2%, preferably less than 1%, and most preferably less than 0.5% by weight. The anticaking or antisetting agent can be an inert material, such as diatomaceous earth, clay, talc, limestone, chalk, or combinations of these materials, or an organic antisetting agent. The moisture content of the ammonium nitrate should be less than 3%, preferably less than 1%, and most preferably less than 0.5% by weight water for best results.

In the preferred process, ammonia is withdrawn and separated from the light hydrocarbon gases and the water exiting the separator 22 and reacted to produce ammonium nitrate. In one method of producing ammonium nitrate, some of the ammonia is reacted with air in the presence of a platinum catalyst to produce nitric acid. The resultant nitric acid product is then absorbed in water and reacted with more ammonia to form ammonium nitrate. The ammonium nitrate product is then heated to evaporate the remaining water. The ammonia can also be processed to produce ammonium nitrate by neutralization or reaction of nitric acid with gaseous or liquid ammonia as more fully described in the November 1979 issue of *Hydrocarbon Processing* at pages 134 and 135, which is hereby incorporated by reference. Other conventional processes for producing ammonium nitrate from ammonia can also be used.

Ammonium nitrate prills can be made in a prilling process in which a molten 95% solution is sprayed in a prilling tower against a countercurrent flow of air. The droplets of ammonium nitrate solidify as they fall through the prilling tower. Ammonium nitrate is collected at the bottom of the prilling tower and is conveyed to a series of rotary or fluid bed dryers to remove the remaining amount of water.

The critical diameter is the minimum diameter at which a stable detonation will propagate. The optimum diameter is the minimum diameter at which an increase in diameter no longer has an appreciable effect on the detonation velocity. Every explosive of a given composition, density and grain size distribution has a critical charge diameter below which it will not propagate a detonation.

The heat of reaction of explosive grade ammonium nitrate prills and shale oil is greatest at oxygen balance. Detonation velocity of ammonium nitrate shale oil explosives is a maximum when the shale oil content is at a level that results in a compound oxygen balance that is slightly negative. For low percentages of shale oil at the surface portion of the prills, a stoichiometric condition exists that causes a higher detonation velocity because there is near oxygen balance for the portion of the prill that reacts within the detonation head. A large excess of shale oil is less detrimental to the detonation velocity than a shortage of shale oil. As the shale oil content decreases and the oxygen balance becomes more positive, there is a substantial decrease in the detonation velocity.

The particle size and particle size distribution of the ammonium nitrate as well as its bulk density are important factors in determining the sensitivity, stability and rate of detonation of the ammonium nitrate shale oil explosives. Excessive shale oil should be avoided in the explosive because it has a desensitizing effect on the blasting agent and because it decreases the chance for proper initiation.

Adequate priming should be employed with ammonium nitrate shale oil explosives to guard against misfires, increased toxic fumes, and inadequate performance. The kind and amount of primer used is governed by the sensitivity of the blasting agent, hole diameter, and other factors.

Ammonium nitrate shale oil explosives made in accordance with the process of this invention, are sometimes referred to as ammonium nitrate shale oil blasting agents. Adding aluminum flakes to the ammonium nitrate shale oil blasting agent can increase its energy output but increases its cost.

The minimum primer required to initiate detonation of the ammonium nitrate shale oil explosive increases as charge diameter increases. A primer is a charge of easily initiated explosive placed within the main charge of the ammonium nitrate shale oil blasting agent to initiate detonation. The terms "primer" and "booster" are used interchangeably to generally describe a charge that does not contain an initiating device.

The electric blasting cap is the most commonly used initiating device for activating high explosives, such as ammonium nitrate shale oil explosives. The electric blasting cap may be inserted directly into the explosive cartridge or can be used with a detonating cord. The detonating cord or detonating fuse can be a core of high explosives, usually PETN (pentaerythritol tetranitrate), contained in a waterproof plastic sheet and enclosed in a reinforcing covering of textile, plastic and wire. The detonating fuse will propagate when externally wet, but should be initiated at a dry end. Millisecond delay connectors are available for use when delay blasting is desired. Delay electric blasting caps are also available. Slow delays are used primarily underground and in tunnel work, where they provide sufficient time for rock movement between delays.

The fuse cap is an alternate means of initiating ammonium nitrate shale oil explosives. The fuse caps (safety fuse) can be a core of potassium nitrate black powder enclosed in a waterproof textiled covering, which is inserted into the opened end of the cap, butted to the explosive charge, and crimped to form a tight bond. The cap can be used underground where rotational firing is necessary. It is also useful in single shot work, such as in agriculture and secondary blasting. Fuse caps require cautious handling because the explosive is exposed at the open end of the cap. The cap and fuse combination, however, eliminates the hazard of stray electricity (radio-frequency energy) and the need for a power source and associated lead wires.

In loading small-diameter bore holes, the primer should be placed at the bottom of the hole for maximum confinement of detonation. In order to minimize air blast and flying rock violence, the distance from the top of the explosive column to the bore hole collar should be about 14 to 28 times the bore hole diameter. The use of stemming reduces air blast and helps confine the explosive gases.

Blasting agents such as ammonium nitrate shale oil may be pneumatically loaded, poured from the bag, or loaded by cartridge to small diameter bore holes. Pneumatic loading improves ammonium nitrate shale oil performance by pulverizing the prills, thereby giving higher loading densities and greater sensitivity. The benefits of high velocity pneumatic loading increases as the bore hole diameter approaches one inch.

In the retorting process and system of FIG. 1, the retorted and spent oil shale particles are discharged from the bottom of the retort and are fed by gravity flow through combustor feed line 40 to the bottom portion of an external dilute phase, vertical lift pipe combustor 42. Shale dust removed from the product stream in cyclone 20 can also be conveyed by gravity flow through dust outlet line 44 to the bottom portion of the lift pipe. The lift pipe is positioned remote from the retort.

Air or some other oxygen-containing combustion-sustaining lift gas is injected into the bottom of the lift pipe 42 through injector inlet 46. The air is injected at a pressure and a flow rate to fluidize, entrain, propel, convey and transport the retorted and spent shale particles and shale dust generally upwardly through the lift pipe into an overhead combustor vessel 48, which is also referred to as an overhead collection and separation bin. The combustion temperature in the lift pipe and overhead vessel is from 1000° F. to 1400° F. Residual carbon contained on the retorted oil shale particles is substantially completely combusted in the lift pipe and overhead vessel leaving spent shale for use as solid heat carrier material. Spent shale is discharged through an outlet in the bottom of the overhead vessel into heat carrier feed line 16 where it is fed by gravity flow into the top of the retort. Excessive spent shale is withdrawn from the overhead vessel and retort system through discharge line 50. Methane and other light hydrocarbon gases from the separator (fractionator) and/or some shale oil can be fed to the combustor as auxiliary fuel.

The carbon contained in the retorted oil shale particles is burnt off mainly as carbon dioxide during combustion in the lift pipe and overhead vessel. The carbon dioxide with the air and other products of combustion form combustion off gases or flue gases which are withdrawn from the upper portion of the overhead vessel through a combustion gas line 52. The combustion gases are dedusted in an external cyclone or an electrostatic precipitator before being discharged into the atmosphere or processed further to recover heat or produce steam or for other uses.

While an external dilute phase combustor lift pipe is preferred for best results, in some circumstances it may be desirable to use a different type of combustor, such as a horizontal combustor or an internal dilute phase lift pipe which extends vertically through a portion of the retort. If ceramic and/or metal balls are used as the solid heat carrier material, the retorting system should also have a ball separator, such as a rotating trommel screen, and a ball heater in lieu of or in combination with the combustor.

Figure 2:
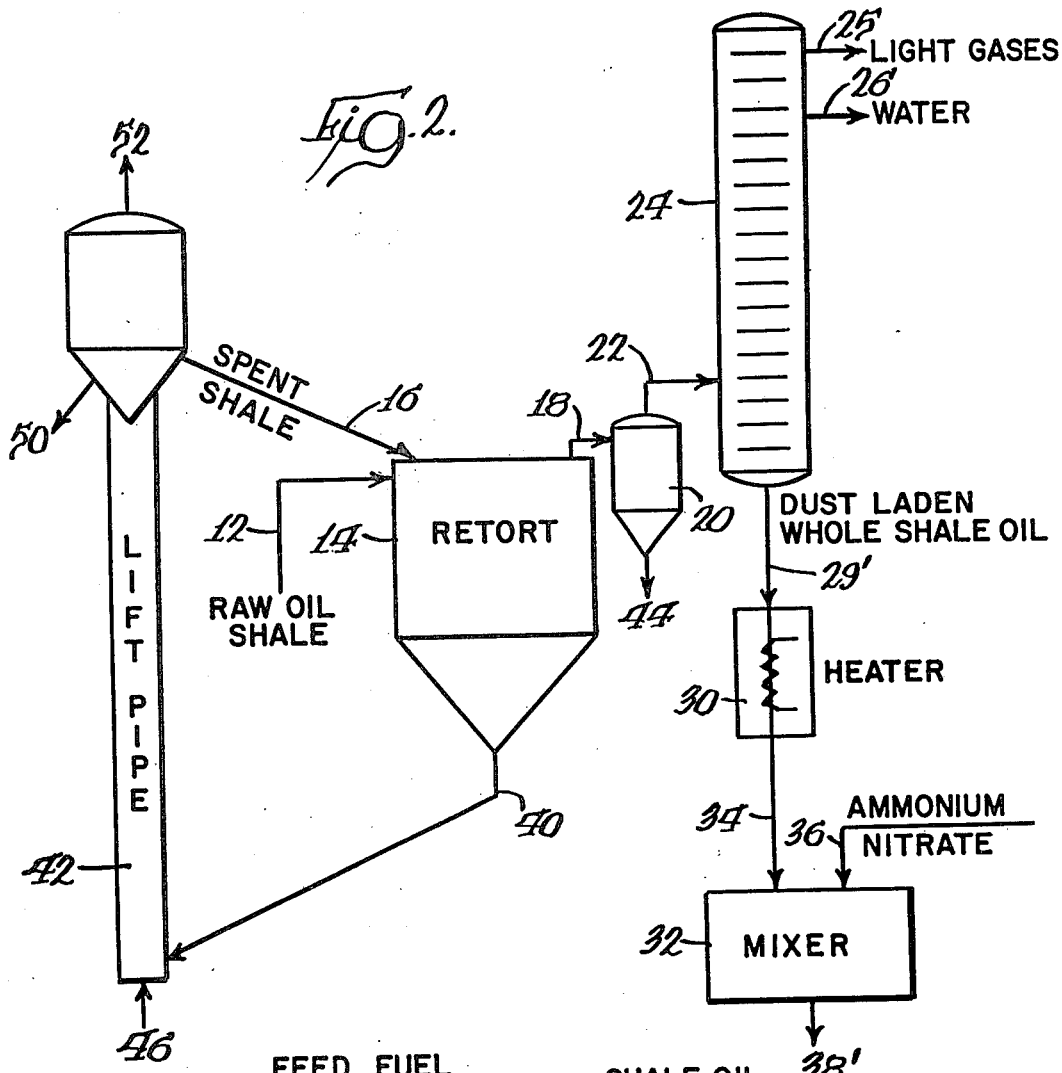
FIG. 2 is an alternative embodiment of FIG. 1.

The process and retorting system of FIG. 2 is similar to the process and system of FIG. 1, except that the effluent product stream of hydrocarbons, ammonia and water is separated in separator 24 into fractions of light hydrocarbon gases, water and dust-laden whole shale oil. The dust-laden whole oil fraction contains from 0.1% to 15% by weight entrained particulates of shale dust. Whole shale oil consists of heavy shale oil, middle shale oil, and light shale oil. The light hydrocarbon gases and water are partially or fully saturated with ammonia. The process for producing ammonium nitrate shale oil explosives is similar to that described with respect to FIG. 1, except that whole shale oil is used instead of heavy shale oil.

Figure 3:
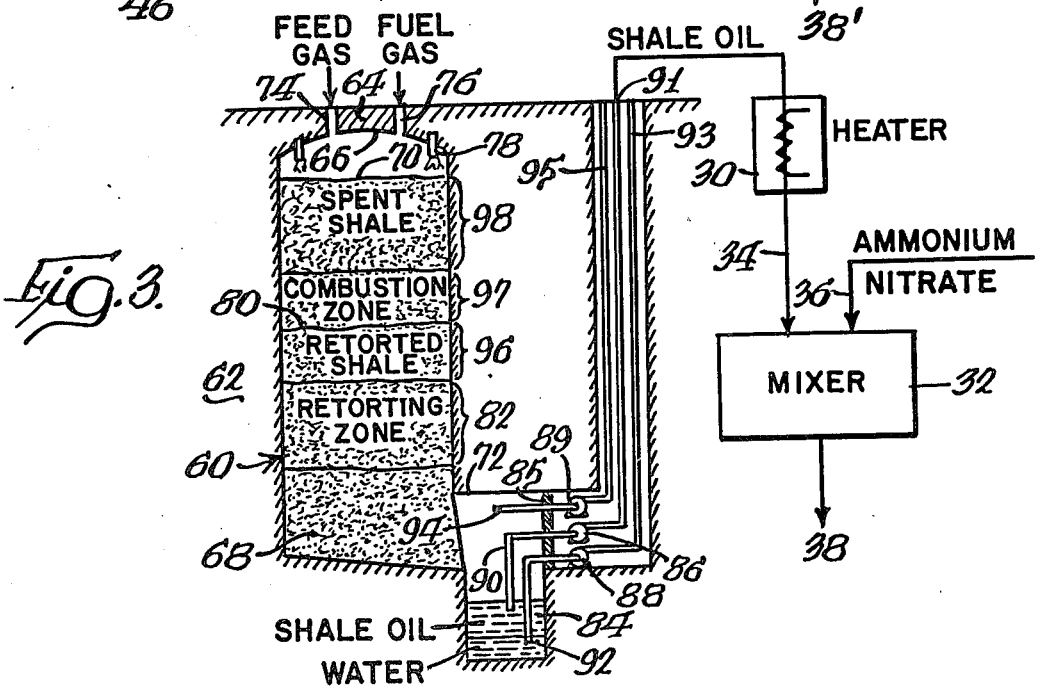
FIG. 3 is a schematic flow diagram of a modified in situ oil shale retorting process for producing ammonium nitrate shale oil explosives in accordance with principles of the present invention.

Referring now to FIG. 3 of the drawings, an underground, modified in situ, oil shale retort 60, located in a subterranean formation 62 of oil shale, is covered with an overburden 64. Retort 60 is elongated, upright and generally boxed-shaped with a flat or dome-shaped roof 66. Retort 60 is filled with an irregularly packed, fluid-permeable, rubblized mass or bed 68 of oil shale. The top 70 of the bed is spaced below the roof.

The rubblized mass is formed by first mining an access tunnel or drift 72 extending horizontally into the bottom of the retort and removing from 2% to 40% and preferably from 15% to 25% by volume of the oil shale from a central region of the retort to form a cavity or void space. The removed oil shale is conveyed to a surface retorting system above ground, such as the surface retorting system of FIG. 1 or FIG. 2, where it is retorted and processed to produce shale oil, ammonia, light hydrocarbon gases, and ammonium nitrate shale oil explosives as explained above.

The underground mass of oil shale surrounding the cavity is fragmented and expanded by detonation of explosives to form the rubblized mass. In the preferred method of explosively forming the underground retort, the mass of oil shale is explosively fragmented and rubblized progressively upwardly in sections from the bottom portion of the retort. The explosives are lowered into the desired section through a series or pattern of blast holes 74 and 76 and these sections are intermittently and sequentially exploded. For economy, process efficiency, and improved use of by-products, ammonium nitrate shale oil explosives produced from surface or underground retorting systems in accordance with this invention are used to explosively fragment and rubblize the underground formation of oil shale. Most preferably, the ammonium nitrate shale oil explosives are detonated with a heavy primer.

After the oil shale has been explosively rubblized, one or more feed gas lines and fuel lines can be inserted into the blast holes 74 and 76, respectively, and downhole burners 78 can be installed. Lines 74 and 76 and burners 78 extend vertically from aboveground through the roof 66 of the retort. The bottom of the burners can be located in the empty space between the top of 70 of the bed and the roof 66.

In order to commence retorting of the rubblized oil shale, a liquid or gaseous fuel, preferably a fuel gas, such as recycled off gases or natural gas, is fed into the retort through fuel line 76 and an oxygen-containing, flame front-supporting, feed gas, such as air, is fed into the retort through feed gas line 74. Burners 78 are then ignited to establish a flame front 80 generally horizontally across the bed 68. If economically feasible or otherwise desirable, the rubblized mass of oil shale can be preheated to a temperature slightly below its retorting temperature, preferably with an inert pre-heating gas, such as steam, nitrogen or retort off gases, before introduction of the oxygen-containing feed gas and ignition of the flame front.

After ignition, ingress of fuel gas is shut off by closing a fuel gas valve (not shown). Once the flame front is established, residual carbon contained in the oil shale usually provides an adequate source of fuel to maintain the flame front in the oil shale as long as the oxygen-containing feed gas is supplied to the flame front. Strata or zones of lean oil shale may have to be supplemented with auxiliary fuel, such as fuel gas or some of the residual shale oil in the retorting zone.

The feed gas sustains and drives the flame front 80 downwardly through the bed 68. The feed gas can be air, or air enriched with oxygen, or air diluted with steam or recycle retort off gases, as long as the feed gas has at least 5 percent, preferably from 10% to 30%, and most preferably a maximum of 20% by volume oxygen. The oxygen content of the feed gas can be varied throughout the process. An inert purge gas, such as steam, can also be intermittently injected in pulses into the underground retort, when the feed gas is temporarily turned off, in order to enhance uniformity of the flame front.

The flame front 80 emits combustion off gases and generates heat which moves downwardly ahead of the flame front and heats the raw, unretorted oil shale in the retorting zone 82 to a retorting temperature from 800° F. to 1200° F. to retort and pyrolyze the oil shale in the retorting zone. During retorting, ammonia, steam, and hydrocarbons are liberated from the raw oil shale as a gas, vapor, mist or liquid droplets and most likely a mixture thereof. The liberated hydrocarbons include normally liquid whole shale oil which flows downward, condenses and liquefies upon the cooler, unretorted raw oil shale below the retorting zone.

Off gases emitted during retorting include various amounts of hydrogen, carbon monoxide, carbon dioxide, ammonia, hydrogen sulfide, carbonyl sulfide, oxides of sulfur, nitrogen, water vapors, ammonia, and low molecular weight hydrocarbons. The composition of the off gases are dependent on the composition of the feed gas.

The effluent product stream of liquid whole shale oil, condensed water and off gases, flow downward to the sloped bottom of the retort and then into a collection basin and separator 84, also referred to as a "sump", in the bottom of access tunnel 72. An upright concrete wall 85 prevents leakage of off gases into the mine. The liquid shale oil, water and gases are separated in the collection basin by gravity and pumped to the surface by pumps 86 and 88 and blower 89, respectively, through inlet and return lines 90–95, respectively.

Raw off gases can be recycled as part of the fuel gas or feed gas, either directly or after light gases, oil vapors, and ammonia contained in the off gases have been stripped away in a quench tower, stripping vessel, or other separator.

During the retorting process, the retorting zone 82 moves downward leaving a layer or band 96 of retorted shale with residual carbon. The retorted shale layer 96 above the retorting zone 82 defines a retorted zone which is located between the retorting zone 82 and the flame front 80 of combustion zone 97. Residual carbon in the retorted shale is combusted in the combustion zone 97 leaving spent, combusted shale in a spent shale zone 98.

Whole shale oil produced during modified in situ retorting typically contains less than 3%, preferably less than 0.5%, and most preferably less than 0.1%, by weight particulates of oil shale dust ranging in size from 1000 microns to less than 1 micron. The oil shale dust is mainly spent (combusted) shale, but can also include raw oil shale as well as retorted shale.

The dust-laden whole shale oil is pumped above ground where it is preferably partially dedusted in a cyclone or other dedusting equipment. The partially dedusted whole shale oil can be heated in a heater 30 before being mixed with ammonium nitrate in a mixer 32 to produce ammonium nitrate shale oil explosives in a manner similar to that described with respect to FIG. 2. If desired, the shale oil can be separated into fractions of light shale oil, middle shale oil and dust-laden heavy shale oil in a separator, such as a fractionator, quench tower or scrubber, with only the dusty heavy shale oil being fed to the heater and mixer to produce ammonium nitrate shale oil explosives in a manner similar to that described with respect to FIG. 1.

Figure 4:
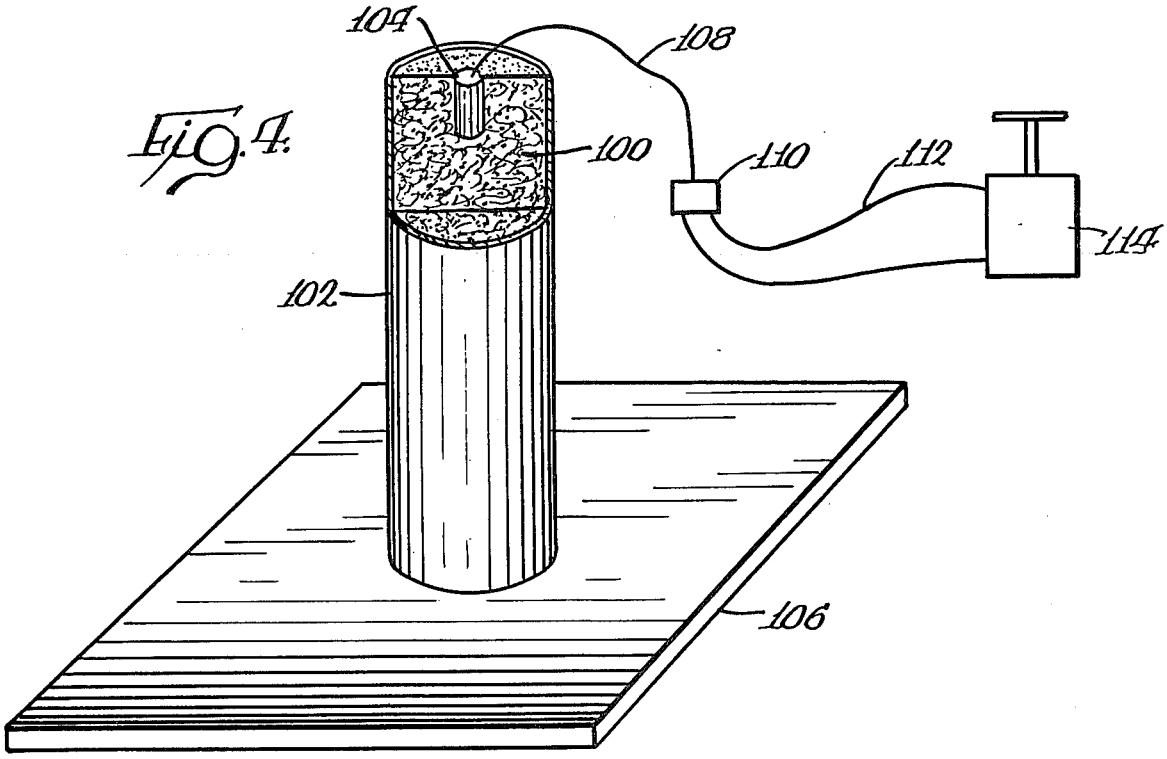
FIG. 4 is a schematic diagram of the blasting test used for testing ammonium nitrate shale oil explosives; some of the components of the diagram are shown in perspective with sections removed for clarity and ease of understanding.
Figure 5:
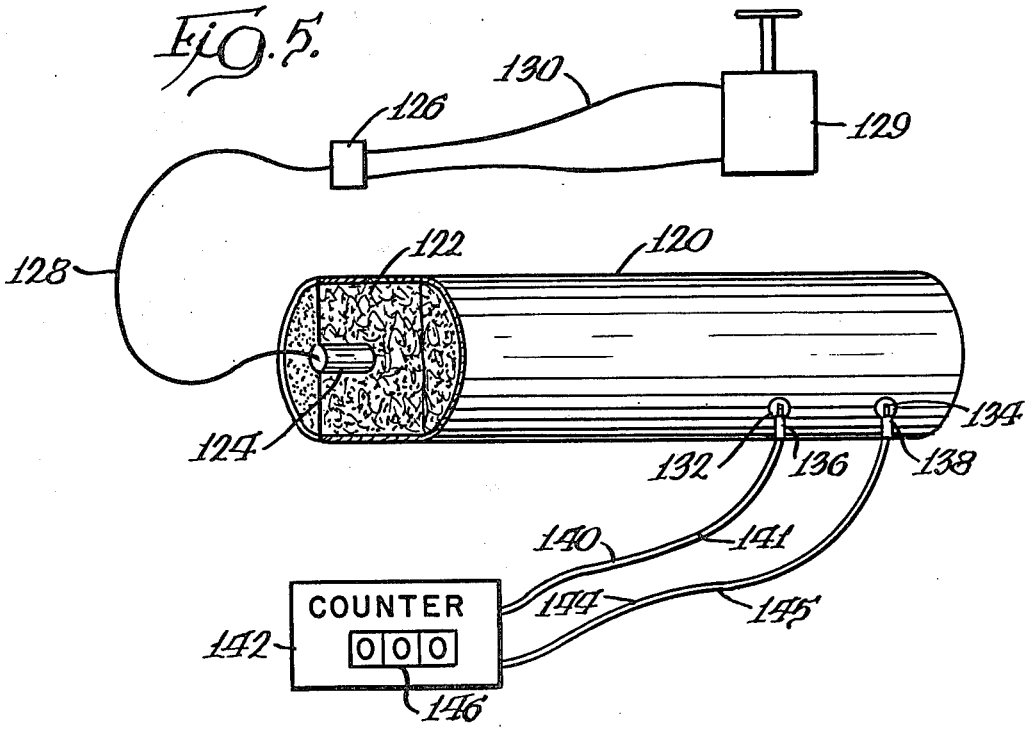
FIG. 5 is a schematic diagram of the velocity test used for testing ammonium nitrate shale oil explosives; some of the components of the diagram are also shown in perspective with sections removed for clarity and ease of understanding.

Ammonium nitrate shale oil explosives produced from aboveground surface retorts and underground modified in situ oil shale retorts in accordance with the processes of FIGS. 1-3 were tested in a minimum booster test and a standard velocity test. The minimum booster test, which is also referred to as the blasting test, minimum primer test, or cap-sensitivity test, is illustrated in FIG. 4. The standard velocity test is illustrated in FIG. 5.

The minimum booster test is a test recommended by the Bureau of Mines for operators, blasting foreman, safety engineers, and others, to determine the sensitivity of explosives or blasting agents to initiation by a given primer. If the witness plate is explosively cratered or otherwise deformed, or is driven into the ground, the explosive or blasting agent is proven to have detonated completely to the end of the test container. In the event the primer was a #8 blasting cap strength or less, then the test is also indicative that the explosive or blasting agent is cap sensitive, a designation important to safety in storage and transportation regulations.

In the minimum booster test (FIG. 4), the ammonium nitrate shale oil explosive 100 was poured into a spiral wound paper tube 102 having 4 to 5 plies and a wall thickness of approximately 3/32 inch. The tube was 18 inches long and had a diameter of 4 inches. A booster or primer 104 was buried in the explosive in the upright open end of the tube. Tissue paper filler was placed in the tube and the top and bottom of the tube was taped with masking tape to prevent the primer and the ammonium nitrate fuel oil explosive from moving and spilling when the tube was moved to the test site.

At the barricaded test site, the tube 102 (FIG. 4) was placed upright with the bottom portion of the tube seated upon a steel witness plate (test plate) 106. The steel witness plate was 8 inches square and ½ inch thick. A detonation cord or pigtail 108 of 12 to 18 inches long was attached to the booster 104 on one end and connected to a commercial No. 8 electric blasting cap 110 on the other end, placing the blasting cap away from the tube, externally of the ammonium nitrate shale oil explosive. The cap was therefore not a contributing part of the initiating shock. Shooting lines 112 were connected to the blasting cap 110 and a blasting machine 114. The shooting lines were long enough to permit the blaster to activate the blasting machine at a safe distance from the blast behind the barricade.

Observers could see and hear when the ammonium nitrate shale oil explosive was successfully detonated. Successful detonation was clear cut. The blast from successful detonation deformed the witness plate, either by curling the witness plate, blowing holes in the witness plate, and/or puncturing craters in the witness plate, and/or drove the witness plate deep into the ground. Failure was recorded when the blast noise was at a relatively low level and the undetonated ammonium nitrate shale oil in the tube remained on the witness plate. Testing began with a primer or booster of relatively middle strength and progressed to weaker or stronger primers (boosters) until the size at which both a detonation and a failure were obtained.

The velocity test measures the velocity of detonation of the ammonium nitrate shale oil explosives. In the velocity test (FIG. 5), a cardboard spiral wound tube 120, 5-6 inches in diameter and 30 inches long, was filled with the ammonium nitrate shale oil explosive 122. A primer or booster 124 was buried in the ammonium nitrate shale oil in the open end of the tube. In the velocity test, as in the minimum booster test, the primer was connected to a blasting cap 126 by a detonating wire or pigtail 128, and the blasting machine 129 was connected to the blasting cap 126 by shooting wires 130.

In the velocity test, it is normally desirable to use a big primer in order to assure that detonation occurs at full force. Excessively large primers (boosters) do not generate any more explosive force that the proper size primer and are therefore not detrimental to the test, provided they comfortably fit at the open end of the tube.

In the velocity test, two holes 132 and 134 were poked (punched) into the cardboard tube to receive ionization probes or trigger wires 136 and 138, respectively. The first hole 132 was positioned about 20 inches from the primer 124. The second hole 138 was positioned about 6 inches to the right of the first hole. The first probe or starter probe was connected to a pair of insulated starter wires 140 and 141 which were attached to the starter post (terminal) of a counter chronograph 142. The second probe or stopping (finish) probe 138 was connected to a pair of insulated stop wires 144 and 145 which were attached to the stopping post (terminal) of the counter 142.

In the velocity test, the tube was laid down horizontally on its side. No steel witness plate was used as in the minimum booster test. The wires were 500 feet long so that the counter could be protected and shielded away from the blast behind the barricade.

In the velocity test, identical counters were placed in parallel, with the second counter serving as a backup in the event the first counter failed. Each counter had a digital readout 146. Neither counter failed during the test.

When the blasting machine was activated in the velocity test, the blasting cap, booster and ammonium nitrate shale oil explosive were detonated, causing a plasma detonation front to move from the booster 124, at the left end of the tube, to the probes 136 and 138 at the right end of the tube. When the detonation front reached the starter probe 136, it ionized, melted and fused the starter probe, completing the circuit with the starter wires 140 and 141 which activated (started) the counter. When the detonation front reached the stop probe 138, it ionized, melted and fused the stop probe, completing the circuit of the stopping wires 144 and 145, which deactivated (stopped) the counter. The counter measured the time it took in microseconds for the detonation front to move from the starter probe 136 to the stop probe 138. The velocity is determined by the distance (between the probes) divided by the (counter) time from start to finish. Successful detonations were audible and visible. If the counter indicated no time or a very long time, or if undetonated ammonium nitrate shale oil was found after the test, the result was recorded as a failure.

EXAMPLE 1

This test served as the control standard for the blasting test (minimum primer test). A 100 pound sample was made in two 50 pound batches by mixing 92.4% ammonium nitrate (unless otherwise specified all percentages in these examples are by weight) with 6% No. 2 diesel fuel oil in a commercial size tumbling cement mixer at an ambient temperature of 72° F. at atmospheric pressure for 15 minutes. Each batch was poured into a PE (polyethylene) lined bag and permitted to stand approximately 24 hours prior to testing. The sample was not heated before being mixed in the tumbler mixer. The ammonium nitrate was Gulf Oil Chemical Company's No. 5 explosive grade ammonium nitrate prills. The prills and ammonium nitrate fuel oil mixture contained 1.6% inert material. In the blasting test, the test sample detonated with a 18 gram Detaprime booster containing approximately 60% pentaerythritol tetranitrate (PETN) and 40% inert binder material.

EXAMPLE 2

A velocity test was conducted on a part of the unused portion of the test sample of Example 1. The detonation front was 10,000 feet per second (fps) with a 16 ounce (1 pound) Pentolite primer. The detonation front was 9,800 feet per second with a 40 gram Pentolite primer.

EXAMPLE 3

A 100 pound test sample was made in a manner similar to Example 1, except that 6% by weight whole shale oil was used instead of the 6% by weight No. 2 diesel fuel oil. The whole shale oil was produced in a modified in situ retort in accordance with the process of FIG. 3. The whole shale oil contained about 0.2% by weight oil shale dust, 1.75% by weight sulfur, 1.72% by weight nitrogen; the remainder was predominantly carbon and hydrogen. The shale oil had an API gravity of 24.1° and a viscosity of 37.7 centistokes at 104° F. The test sample detonated in the blasting test with a 40 gram Pentolite primer containing 50% trinitrotolulene (TNT) and 50% PETN. The test sample failed to detonate with a 36 gram Detaprime booster.

EXAMPLE 4

Velocity tests were conducted on a part of the unused portion of the test sample made in Example 3. The detonation velocity (velocity of the detonation front) of the test sample was 8800 feet per second with a 16 ounce (1 pound) Pentolite primer. The detonation velocity of the test sample was 8900 feet per second with a 40 gram Pentolite primer.

EXAMPLE 5

A 100 pound test sample of ammonium nitrate shale oil was made in a manner similar to Example 3, except that the whole shale oil was heated to 115° F. in a water bath and cooled to 94° F. before being mixed with the ammonium nitrate prills. The test sample contained 91.9% by weight ammonium nitrate, 6% by weight whole shale oil, and 2.1% by weight shale dust and inert material. The whole shale oil contained 8% by weight shale dust. The whole oil shale was obtained from a modified in situ retort. The shale dust was obtained from an electrostatic precipitator downstream of a surface retort. The shale dust (fines) were dried overnight in a nitrogen purged vacuum oven at 60° C. at 5 mm Hg before being vigorously mixed with the whole shale oil in a counter-rotating agitator for 5 minutes and tumbled for 20 minutes. The test sample detonated in the blasting test with a 40 gram Pentolite booster. The test sample failed to detonate with a 36 gram Detaprime booster.

EXAMPLE 6

Velocity tests were conducted on part of the unused portion of the test sample of Example 5. The velocity of the detonation front of the test sample in a 6 inch diamter tube was 9250 feet per second with a 16 ounce (1 pound) Pentolite primer. The test sample failed to detonate in a 5 inch diameter tube with a 40 gram Pentolite primer.

EXAMPLE 7

A 95 pound test sample of ammonium nitrate shale oil was made in a manner similar to Example 5, except that the whole shale oil was heated to 115° F. and cooled to 106° F. before being mixed with the ammonium nitrate. The test sample contained 90.9% by weight ammonium nitrate, 6% by weight whole shale oil, and 3.1% by weight shale dust and inert material. The whole shale oil contained 20% by weight oil shale dust. The test sample detonated in the blasting test with a 40 gram Pentolite booster. The test sample failed to detonate with a 36 gram Detaprime booster.

EXAMPLE 8

Velocity tests were conducted on a part of the unused portion of the test sample of Example 7. The detonation velocity of the test sample was 9100 feet per second with a 16 ounce (1 pound) Pentolite primer. The detonation velocity of the test sample was also 9100 feet per second with a 100 gram Pentolite primer.

EXAMPLE 9

A 100 pound test sample of ammonium nitrate shale oil was made in a manner similar to Example 5, except that the whole oil shale was heated to 115° F. and cooled to 112° F. before being mixed with the ammonium nitrate. The test sample contained 88.5% by weight ammonium nitrate, 6.0% by weight whole shale oil, and 5.5% by weight oil shale dust and inert material. The whole shale oil contained 40% by weight shale dust. The test sample was detonated in the blasting test with a 100 gram Pentolite booster. The test sample failed to detonate with a 40 gram Pentolite booster.

EXAMPLE 10

Velocity tests were conducted on the unused portion of the test sample of Example 9. The velocity of the detonation front of the test sample was 8200 feet per second with a 16 ounce (1 pound) Pentolite primer. The velocity of the detonation front of the test sample was 8700 feet per second with a 100 gram Pentolite primer.

EXAMPLE 11

A 100 pound test sample of ammonium nitrate shale oil was made in a manner similar to Example 1, except that heavy shale oil was used instead of No. 2 diesel fuel oil and No. 6 ammonium nitrate prills containing about 1.8% by weight inert material was used instead of No. 5 ammonium nitrate prills. The inert material in the prills was mainly clay which served as an antisetting agent. The heavy shale oil was heated to 115° F. in its container in a water bath and cooled to 112° F. before being mixed with the ammonium nitrate prills. The heavy shale oil was obtained from surface retorting in accordance with the process of FIG. 1. The heavy shale oil contained about 42% by weight oil shale dust, 0.5% by weight sulfur, 2.5% by weight nitrogen; the remainder was predominantly carbon and hydrogen. The heavy shale oil had an API gravity of 12.8° and a viscosity of 79 centistokes at 104° F. The test sample stirred like roofing tar or paint. The shale oil in the test sample was not heated to result in a sufficiently low viscosity to be flowable and blendable in this test, because it coagulated into balls as large as baseballs or golfballs. The test sample failed the blasting test with a 100 gram Pentolite primer.

EXAMPLE 12

A velocity test was conducted on the unused portion of the test sample of Example 10. The test sample failed to detonate with a 16 ounce Pentolite primer.

EXAMPLE 13

A 100 pound test sample of ammonium nitrate shale oil was made in a manner similar to Example 10, except that the heavy shale oil was heated to 160° F. and cooled to 150° F. before being mixed with No. 5 explosive grade ammonium nitrate prills. The test sample contained 92.5% by weight ammonium nitrate, 6.0% by weight heavy shale oil, and 1.5% by weight shale dust and inert material. The test sample failed to detonate in the blasting test in a 5 inch diameter tube with a 1 pound Pentolite primer.

EXAMPLE 14

Velocity tests were conducted on a part of the unused portions of the test sample of Example 13. The detonation velocity of the test sample was 10,100 feet per second in a 6 inch diameter tube with a 1 pound Pentolite primer. The test sample failed to detonate with the same size primer in a 5 inch diameter tube.

EXAMPLE 15

A 100 pound test sample of ammonium nitrate was made in a manner similar to Example 13, except that the heavy shale oil was cooled to a temperature of 148° F. before being mixed with the ammonium nitrate prills. The test sample contained 91.9% by weight ammonium nitrate, 6.0% by weight heavy shale oil, and 2.1% by weight oil shale dust and inert material. The heavy shale oil contained 8.9% by weight oil shale dust. The test sample failed to detonate in the blasting test in a 5 inch diameter tube with a 1 pound booster.

EXAMPLE 16

Velocity tests were conducted on a part of the unused portion of the test sample of Example 14. The velocity of the detonation front of the test sample was 8,330 feet per second in a 6 inch diameter tube with a 1 pound Pentolite primer. The test sample failed to detonate with the same primer in a 5 inch diameter tube.

EXAMPLE 17

A 100 pound test sample of ammonium nitrate shale oil was made in a manner similar to Example 10, except that the heavy shale oil was heated to 170° F. and cooled to 160° F. before being mixed with the ammonium nitrate prills. The test sample contained 90.6% by weight ammonium nitrate, 5.9% by weight heavy shale oil, and 3.5% by weight oil shale dust and inert material. The heavy shale oil contained 25% by weight oil shale dust. The test sample failed to detonate in the blasting test in an 18 inch long, 5 inch diameter tube with a 1 pound booster.

EXAMPLE 18

Velocity tests were conducted on a part of the unused portion of the test sample of Example 16. The detonating velocity of the test sample was 8,000 feet per second in a 30 inch long, 5 inch diameter tube with a 1 pound Pentolite primer. The detonation velocity of the test sample was 10,420 feet per second in a 30 inch long, 6 inch diameter tube with a 1 pound Pentolite primer.

It can be seen that all the test samples detonated with acceptable detonation velocities in a 5 or 6 inch diameter tube with a proper size booster, except the test samples of Examples 11 and 12 which were attributable to insufficient heating before being mixed.

The ammonium nitrate shale oil compositions of Examples 12, 14 and 16 which were not detonated by a No. 8 test blasting cap under the conditions specified for in the cap sensitivity test (blasting test) but which detonated under the velocity test in Examples 13, 15 and 17, can be characterized as a blasting agent. Under federal regulations, a blasting agent is any material or mixture consisting of a fuel and an oxidizer intended for blasting, which is not otherwise classified as an explosive, and in which none of the ingredients is classified as an explosive, provided that the material or mixture cannot be detonated by a No. 8 test blasting cap under the conditions specified for the cap sensitivity test.

Ammonium nitrate shale oil explosives require a minimum confinement before detonation. Confinement is determined by the length and diameter of the tube as well as the amount of ammonium nitrate shale oil placed in the tube. Thus, the test samples in Examples 12 and 14 did not detonate in a 4 inch diameter by 18 inch long tube in the blasting test, but detonated in a 6 inch diameter by 30 inch tube in the velocity test.

In contrast to No. 2 diesel fuel oil, as well as other types of oil, shale oil contains significant amounts of oil shale dust as well as sulfur and nitrogen. In order to attain an ammonium nitrate shale oil composition having a maximum oil shale dust content of 0.5 weight percent, the heavy or whole shale oil content by weight should be about: (a) 3% with a maximum of 17% by weight oil shale dust, (b) 4% with a maximum of 12% by weight oil shale dust, (c) 5% with a maximum of 10% by weight oil shale dust, (d) 6% with a maximum of 8% by weight oil shale dust, (e) 7% with a maximum of 7% by weight oil shale dust, (f) 8% with a maximum of 6% by weight oil shale dust, (g) 9% with a maximum of 5.5% by weight oil shale dust, and (h) 10% with a maximum of 5% by weight oil shale dust.

The production of ammonium nitrate shale oil explosives from ammonia and dust laden shale oil produced during the retorting process reduces the quantities of by-products and dusty oil that have to be cleaned up, dedusted, upgraded and/or otherwise processed. This saves processing costs while producing a valuable and useful explosive product. Advantageously, the explosives are relatively inexpensive and safe to handle. Ammonium nitrate shale oil explosives are powerful and have good fume properties.

Although embodiments of this invention have been shown and described, it is to be understood that various modifications and substitutions, as well as rearrangements and combinations of parts, equipment, and/or process steps, can be made by those skilled in the art without departing from the novel spirit and scope of this invention.

What is claimed is:

1. An ammonium nitrate shale oil explosive composition, consisting essentially of:

from about 2% to about 10% by weight shale oil containing particulates of oil shale ranging in size from less than one micron to 1000 microns, said shale oil having a substantially greater concentration of nitrogen than diesel number 2 fuel oil and natural petroleum crude oil, said particulates of oil shale being selected from the group consisting essentially of raw oil shale, retorted oil shale, combusted oil shale, and combinations thereof; and from about 90% to about 98% by weight ammonium nitrate containing less than 2% by weight substantially inert material, said ammonium nitrate being selected from the group consisting essentially of granular ammonium nitrate, flaked ammonium nitrate, prilled ammonium nitrate, and combinations thereof.

2. An explosive composition in accordance with claim 1 wherein said shale oil consists essentially of heavy shale oil and a maximum of 50% by wieght particulates of oil shale.

3. An explosive composition in accordance with claim 1 wherein said shale oil consists essentially of whole shale oil and less than 15% by weight particulates of oil shale.

4. An explosive composition in accordance with claim 1 wherein said ammonium nitrate comprises less than 3% by weight water and said inert material is selected from the group consisting essentially of diatomaceous earth, clay talc, limestone, chalk, and combinations thereof.

5. An explosive composition in accordance with claim 1 wherein said shale oil contains a substantially greater concentration of sulfur heteroatoms than diesel number 2 fuel oil.

6. An ammonium nitrate shale oil explosive composition, consisting essentially of:

from about 2% to about 10% by weight shale oil, said shale oil containing a maximum of 65% by weight oil shale particulates ranging in size from less than 1 micron to 1000 microns, said oil shale particulates comprising clays and calcium and magnesium oxides, silicas, and silicates; and from about 90% to about 98% by weight explosive grade ammonium nitrate prills having a bulk density ranging from 0.80 gram/cc to 1.57 grams/cc, said explosive grade ammonium nitrate prills having a moisture content of less than 3% by weight water.

7. An explosive composition in accordance with claim 6 wherein said explosive composition has a bulk density ranging from 0.82 grams/cc to 1.15 grams/cc, and said ammonium nitrate prills have a moisture content of less than 1% by weight water.

8. An explosive composition in accordance with claim 6 wherein said shale oil consists essentially of heavy shale oil having a boiling point over 600° F. and from 0.1% to 50% by weight oil shale particulates.

9. An explosive composition in accordance with claim 8 wherein said heavy shale oil has a maximum concentration of 25% by weight oil shale particulates.

10. An explosive composition in accordance with claim 6 wherein said shale oil consists essentially of whole shale oil and from 0.1% to 15% by weight oil shale particulates, said whole shale oil consisting essentially of light shale oil having a boiling point over 100° F., middle shale oil having a boiling point over 400° F., and heavy shale oil having a boiling point over 600° F.

11. An explosive composition in accordance with claim 6 wherein said ammonium nitrate prills have an anticaking-agent coating having a maximum concentration of about 2% by weight.

12. An explosive composition in accordance with claim 11 wherein the maximum concentration of said anti-caking-agent coating is 0.5% by weight.

13. An explosive composition in accordance with claim 6 wherein said oil shale particulates are at least partially saturated with said shale oil.

14. An explosive composition in accordance with claim 6 having a maximum viscosity of 50 saybolt universal seconds.

15. An explosive composition in accordance with claim 14 having a maximum mesh size of one centimeter.

* * * * *